United States Patent [19]

Nystrand

[11] 3,947,013

[45] Mar. 30, 1976

[54] METHOD OF ZIG-ZAG FOLDING AND APPARATUS THEREFOR

[75] Inventor: Ernst Daniel Nystrand, Green Bay, Wis.

[73] Assignee: Paper Converting Machine Company, Green Bay, Wis.

[22] Filed: July 22, 1974

[21] Appl. No.: 490,239

[52] U.S. Cl. ..... 270/79

[51] Int. Cl.[2] ..... B65H 45/20

[58] Field of Search ..... 270/39, 73, 79

[56] References Cited

UNITED STATES PATENTS

| | | | |
|---|---|---|---|
| 2,246,336 | 6/1941 | Wyrick | 270/39 |
| 3,784,188 | 1/1974 | DeLigt | 270/79 |

*Primary Examiner*—Edgar S. Burr
*Assistant Examiner*—A. Heinz
*Attorney, Agent, or Firm*—Dawson, Tilton, Fallon & Lungmus

[57] ABSTRACT

A method of zig-zag folding and apparatus therefor wherein two endless belts are each equipped with tuckers and grippers to engage a web continuously and uniformly advanced toward the point of tucker web engagement, the paths of belt travel in the zone contacting the web to be zig-zag folded being of the order of about 60°, and wherein there is a means for providing a controlled surplus of the web spaced upstream of the point of folding, the surplus being released at the time of folding to provide precise position of the folds independent of speed.

2 Claims, 6 Drawing Figures

METHOD OF ZIG-ZAG FOLDING AND APPARATUS THEREFOR

BACKGROUND AND SUMMARY OF INVENTION:

Zig-zag folding has been utilized in the paper field since before the turn of the century. Although there are many forms of zig-zag folding apparatus, two general types emerge -- one in which the tuckers cooperate with mechanically controlled grippers and the second wherein the grippers are not mechanically controlled. Representative of the first type is Lewis U.S. Pat. No. 1,109,296 and my U.S. Pat. No. 3,195,882. Representative of the second is Wyrick U.S. Pat. No. 2,246,336 and DeLigt U.S. Pat. No. 3,784,188. This invention has to do with the second type.

The zig-zag folder employing mechanically actuated grippers gives more precise control over the position of the fold but at the expense of much more complicated equipment and unsatisfactory noise levels. On the other hand, the second type seemingly would avoid both of these drawbacks, but without the utilization of the instant invention, I found that it was not possible to reliably obtain reproducibility of folding at the precise positions desired independent of speed. In particular, there is no satisfactory arrangement for operating at web speeds of the order of 1,000 feet per minute. In the case of the mechanically controlled grippers, the noise level is quite high, while in the uncontrolled gripper type, the high speed cannot be maintained reliably -- i.e., folding at predetermined locations.

It will be appreciated that precision in locating the line of fold is most desirable. For example, in business forms which are transversely perforated to permit separation of one panel or set from another after printing in a computer or the like, it is essential that the zig-zag folding occur precisely at the lines of perforation. Further, even where there is no transverse perforation, it is still desirable (as in the case of facial tissues) to have the transverse folds at precisely equally spaced apart distances to develop a rectangular stack.

These objectives have been realized by the instant invention. The basic folding apparatus is of the simplest arrangement, i.e., providing the folding and release functions within a triangular area which is essentially equilateral. The tuckers and grippers are arranged for travel in loops having portions defining the aforementioned essentially equilateral triangle -- in the illustrated embodiment, the loops are adjacent at the point of tucker-web engagement and then diverge. By providing a controlled surplus of said web above the point of folding and releasing the surplus simultaneously with the folding, I have achieved the desired precision in folding. Although surplus web or slack has been provided previously, as in the aforementioned Wyrick patent, it has not been provided between means for continuously and uniformly advancing the web and retarding means so that the surplus is withheld until the time of tucker web engagement. The slack is then used up by the actual tucking operation and also by the faster travel of the grippers going around the arcuate portion of the loop.

The invention is explained in conjunction with an illustrative embodiment in the accompanying drawing, in which --

Figure 1:
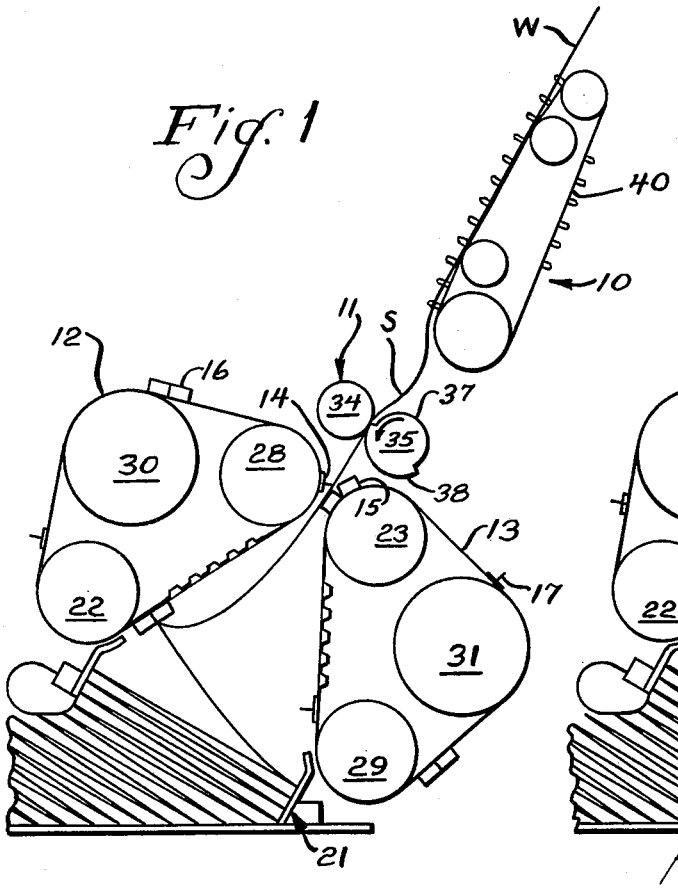
FIG. 1 is a schematic representation of apparatus employed in the practice of the invention.
Figure 2:
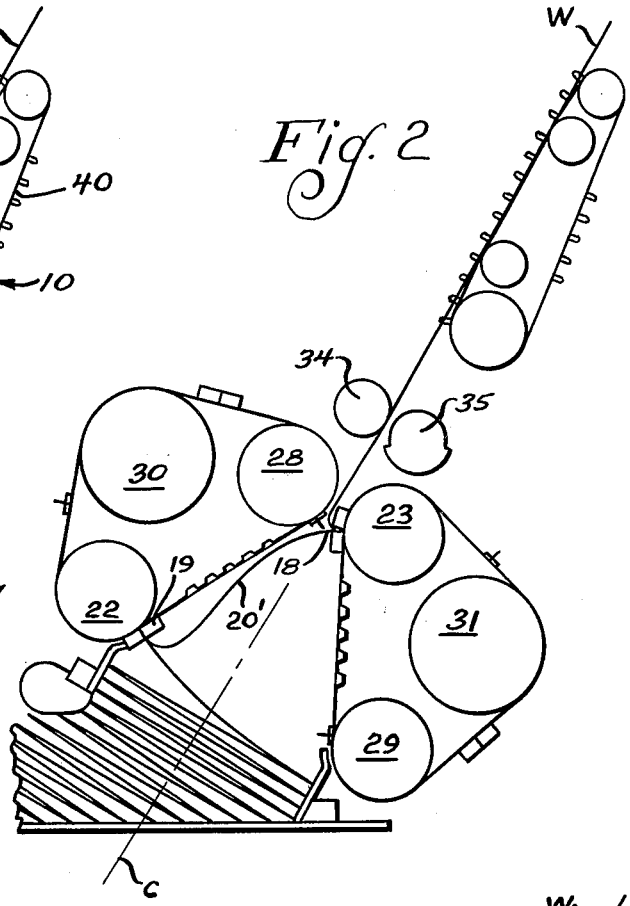
FIGS. 2, 3 and 4 are views similar to FIG. 1 but with the parts thereof arranged in slightly different operating positions so as to show a sequence of folding.
Figure 6:
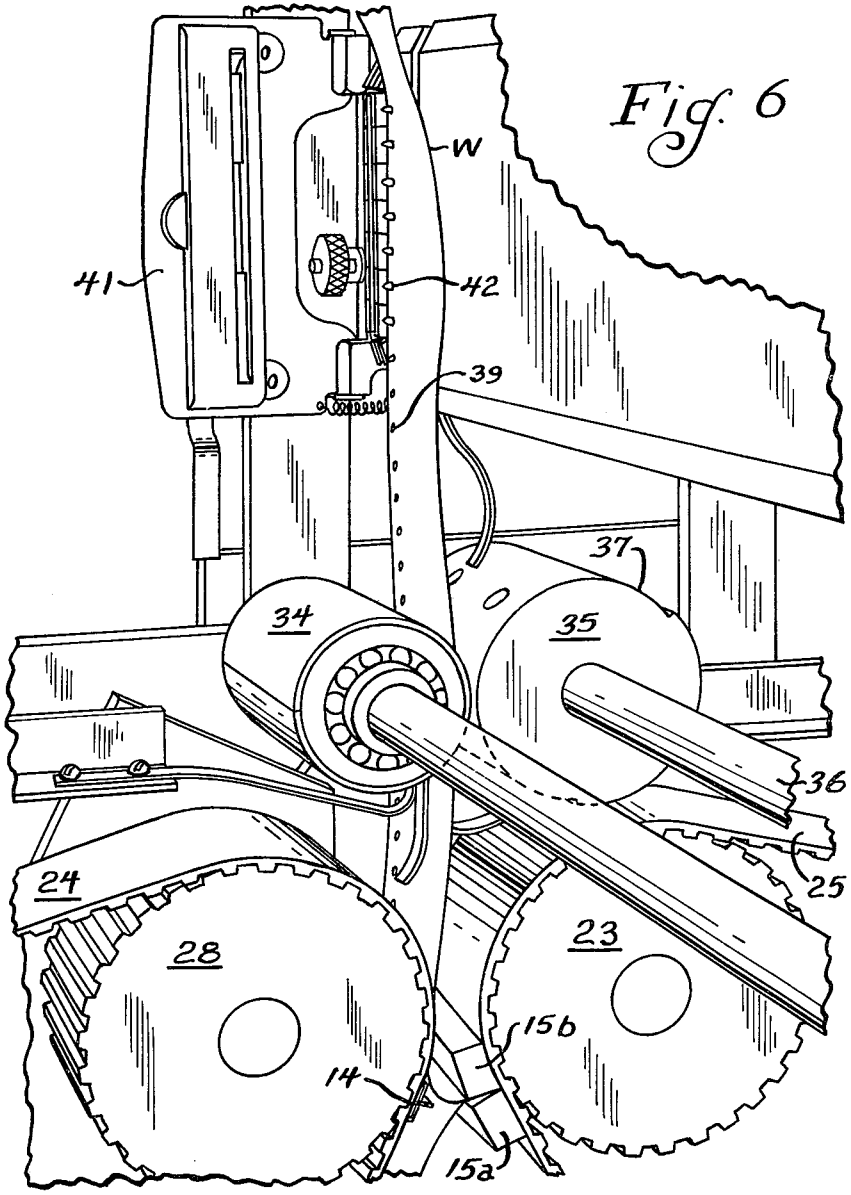
Figure 5:
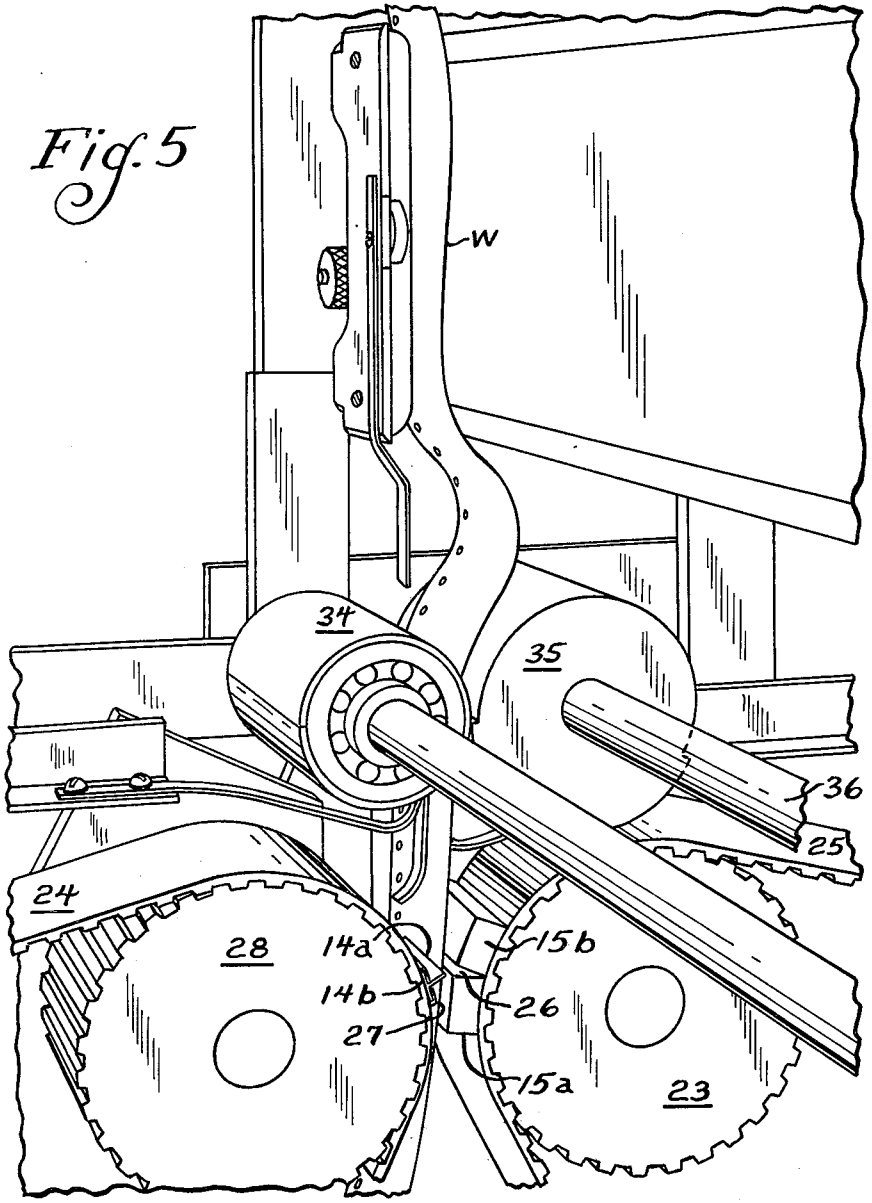

FIG. 5 is a fragmentary perspective view of apparatus embodying the teachings of this invention and corresponding essentially to the showing of FIG. 1; and FIG. 6 is a view similar to FIG. 5 but with operating parts thereof in different operating conditions and correspond essentially to the showing in FIG. 2. FIG. 1, the symbol W designates a web which is to be zig-zag folded. The web is advanced toward the folding zone by means of a web advancing mechanism generally designated 10. Thereafter, the web W encounters a retarding mechanism generally designated 11. As the web proceeds further (downwardly in the illustration given), it passes between two belt systems 12 and 13. The systems are essentially identical but out of phase, i.e., to position a tucker 14 of the belt system 12 in position for engagement with the gripper 15 of the belt system 13.

It will be appreciated that the belt system 12 is operating in a clockwise manner while the belt system 13 is operating in a counterclockwise manner so that at a later stage the gripper 16 of the belt system 12 will cooperate with the tucker 17 of the belt system 13 in developing a subsequent fold. These two elements (gripper 16 and tucker 17) are shown approaching the folding position in FIG. 4.

After a fold has been achieved (as at 18 in FIG. 2), subsequent movement of the two belt systems 12 and 13 causes the preceding gripper 19 of belt system 12 (see FIGS. 2 and 3) to open, while at this stage the gripper 15 firmly clamps the web so that the web panel 20 (extending between the grippers 15 and 19) is removed from the gripper 19 for deposit in a stack confined by a chute generally designated 21.

Figure 3:
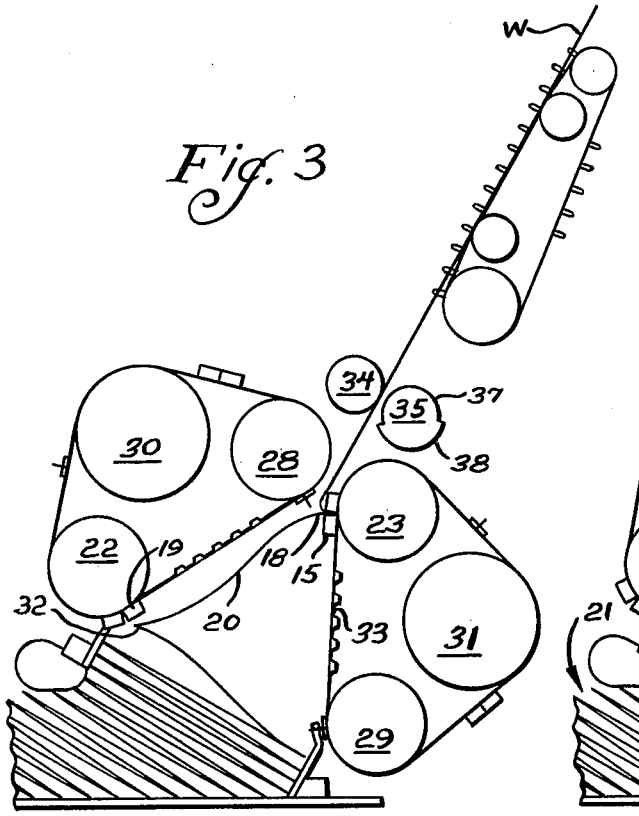

It will be appreciated that the opening and closing of the grippers 15 and 19, for example, is not achieved by special mechanical means but rather occurring as a result of the passing of the gripper around a radius -- as in the case of the showing in FIG. 3, a pulley 22. Also, relative to the gripper 15 of the belt system 13, the pulley 23 causes the elements of the gripper to diverge -- as seen in FIGS. 1 and 2. On the other hand, as the gripper 15 leaves the vicinity of the pulley 23 (as in FIG. 3), the elements are disposed to eliminate any gap therebetween.

The grippers and tuckers, in the illustration given, are cemented to a pair of timing belts 24 and 25 (see FIGS. 5 and 6). Each gripper consists of one leading block **15*a* and one trailing block 15*b*, each of the blocks consisting of resilient material and being cemented adjacent to each other on the timing belt 25. The arrangement is that there is no gap 26 between the blocks 15*a* and 15*b* when the belt is straight, i.e., when the gripper is in that portion of the belt travel which is straight -- see FIG. 4. However, a V-shaped gap 26 appears between the two blocks 15*a* and 15*b* as the belt goes around the pulley 23.**

Each tucker consists of essentially an inverted T blade, the stem **14*a* (see FIG. 5) doing the tucking and the base 14*b* fitting within a thin T-slot member 27** which is cemented to the timing belt.

In the illustration given, the two timing belts 24 and 25 are each fitted with two grippers and two tuckers and are timed, as pointed out previously, to alternately tuck and grip on alternate belts.

Still referring to FIGS. 5 and 6, the web W to be zig-zag folded is advanced down between two adjacent timing belt pulleys 23 or the timing belt 25 and 28 for the timing belt 24. The gripper jaws made up of the blocks 15*a* and 15*b* on the belt 25 are open and the tucker stem or blade 14*a* on the belt 14 is about to push the web W into the V-shaped gap 26.

As the pulleys 23 and 28 revolve further, the tucker 14 (see FIG. 6) withdraws, and as the belts come into the straightaway first the leading gripper 15*a* "closes," i.e., assumes an uncurved configuration and thereafter the trailing gripper jaw 15*b* closes, firmly gripping the tucked-in web.

Figure 4:
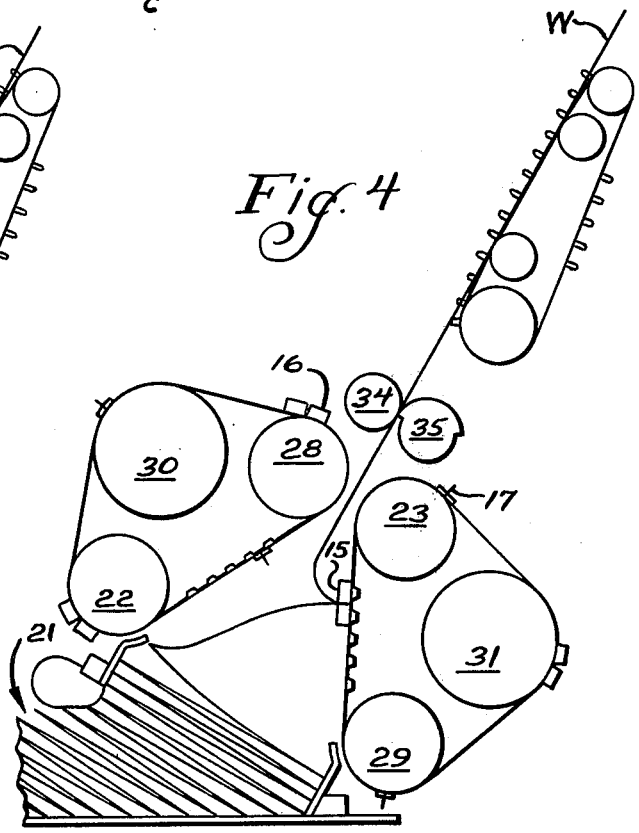

The straight-aways of the two belt systems 12 and 13 diverge at an included angle of approximately 60° and continue around another pair of pulleys 22 and 29 (see FIGS. 3 and 4 at such a distance from the first pulley set (28 and 23) that when a pair of gripper jaws open (as at 19 in FIG. 3) as this gripper goes around the pulley 22, the tucked in portion of the web is pulled out by the web tucked into the closed gripper 15 following on the opposite, diverging belt. The belts continue around tightener pulleys 30 and 31 (see FIGS. 3 and 4) to complete their loops.

The geometry of the folding system, i. e., the triangle formed by the pulleys 28 and 23 at the top and the pulleys 22 and 29 at the bottom is generally equilateral. This results in one fold (as at 32 in FIG. 3) being pulled or removed from its associated gripper 19 by the confinement of the following portion 18 of the web which is restrained by the succeeding gripper 15. As indicated previously, this makes for an uncomplicated system, i.e., one with a minimum of parts to be adjusted in synchronism for high speed operation. The basic geometry of the system is determined by the distance between successive folds. This determines to a certain extent the spacing of the pulleys 22 and 29, the spacing of pulleys 29 and 23 (and likewise the spacing of pulleys of 22 and 28) and the distance between each tucker and gripper, i.e., the distance on belt system 12 between tucker 14 and gripper 16 (alternatively relative to belt system 13, the spacing between gripper 15 and tucker 17). As an illustration, I employ a business form which is perforated at 11 inch intervals. For this, the tucker-gripper distance, in the embodiment shown, is 9.75 inches. With the generally equilateral system shown (one in which the fold just formed is operative to disengage the fold just previously formed), the effective range of tucker-gripper distances is about 9–10 inches. If the distance is larger, i.e., approaching 11 inches, there is insufficient drape (as in the panel 20' (see FIG. 2) between adjacent engaged grippers and this could result in creasing the web W at points other than folds. On the other hand, a substantial reduction in the tuckergripper distance, i.e., below about 9 inches in the illustration given, results in insufficient tautness of the panel portion 20' to cause withdrawal of the fold 32 from the gripper 19. In the specific illustration given, the geometry is as follows (relative to the center line C in FIG. 2): The axis of each pulley 22 and 29 is 7.25 inches from the center line C, the axis of each pulley 28 and 23 is 2.75 inches from the center line C, and the distance along the center line C between the line connecting the axes of the pulleys 22 and 29 and the line connecting the axes of the pulleys 28 and 23 is 8.875 inches. However, even with a carefully engineered generally equilateral system of the nature just described, there remains the problem of insuring that the fold line will always occur at the predetermined position, i.e., at precisely 11 inch intervals in the illustration given. I have resolved this problem through the provision of the feed mechanism 11.

During the tucking and until the gripper 15 (as seen in FIG. 1) gets to the straight-away 33 (see FIG. 3) I provide for a controlled surplus of web material S (see FIG. 1). This is used up by the tucked-in web portion and the higher surface speed of the gripper during the time it is going around the pulley 23. Then as the gripper 15 travels on the straight-away, its surface speed is slower. At this time, I employ the mechanism 11 to build up the controlled surplus S.

More particularly, the controlled surplus S is developed up to the time the tucker 14 touches the web W, and at this point in time, the surplus is made available.

In the illustration given, this is achieved through a pair of rolls 34 and 35, the roll 34 in mechanism 11 being an idler or non-driven roll while the roll 35 is driven by means of shaft 36 (see FIGS. 5 and 6). The roll 35 is a sectional roll, i.e., has a portion of its circumference removed -- as at 37. The roll 35 has an unrelieved portion 38 of such a diameter that if the roll were unrelieved, would produce a circumference of 9.90 inches. The roll 35 is driven through the shaft 36 so as to make one revolution per panel 20, i.e., one revolution for each 11 inch length of web travel. Thus, when the apparatus is in the configuration pictured in FIG. 4, the cooperation of the rolls 34 and 35 retards the web W from advancing between the nip between the rolls 34 and 35 as rapidly as it is fed to that nip by the advancing mechanism 10 -- thereby developing the surplus S seen in FIG. 1. The organization of elements seen in FIG. 1 is at the moment of engagement of the tucker 14 with the web W and it will be noted that at that time the restraining influence of the retarding mechanism 11 is about to cease, i.e., the unrelieved portion 38 will no longer be in contact with the web. This makes possible the surplus S to rapidly pass through the now-opened nip between the rolls 34 and 35 (as in FIG. 2) and be utilized by the tucker 14 for introduction into the gripper 15.

In the illustration given, the part of the circumference of the roll 35 that is cut away or relieved is 210°, so that for 150° of each rotation a surplus is created upstream of the following value:

$$\frac{(11'' - 9.9'')\ 150^\circ}{360^\circ} = .458''$$

The end of the holdback of the feed roll 35 is at the moment the tucker 14 touches the web W. Then the relieved portion 37 of the roll 35 takes over permitting the surplus S to be used up.

For zig-zag folding business forms which are line-hole punched -- as at 39 in FIG. 6, I employ a timed pin belt 40 (see FIG. 1) to feed an exact amount of web for each fold. In the upper portion of FIG. 6, a confining cover 41 is shown in the open position (as contrasted to the showing in FIG. 5), thereby revealing the pin 42 in the timed belt 40.

Other products may have a pair of draw rolls that feed in a predetermined amount of web -- as contrasted to the timed pin belts, and in some instances a variable speed drive to such draw rolls may be utilized. Further, as indicated previously, products other than cross perforated business forms can be advantageously zig-zag folded according to the invention and this includes multiple ply webs such as those that have been longitudinally folded prior to zig-zag folding. Further, the apparatus is advantageously used in connection with interfolding.

In operation, the invention makes use of tuckers and grippers which move in loops -- in the illustration given on cog belts which are entrained around toothed pulleys (as at 28, 23, etc.). Alternatively, chains or other loop-providing means may be employed. The portions of the loops between tucker-web engagement (as at FIG. 1, and relative to the tucker 14) and gripper disengagement (as in FIG. 3 and relative to the gripper 19) -- and considering the counterpart relative to the belt loop 13 -- form two sides of a generally equilateral triangle. Upstream of the point of tucker-web engagement the controlled surplus S is provided (more particularly, upstream of the retarding means or mechanism 11) and this is released upon tucker-web engagement. In the illustration given, the accumulation of the surplus (or untensioned web length) is developed by a pair of rolls arranged in side-by-side relation to provide a selectively openable nip (as between the rolls 34 and 35).

I claim:

1. Apparatus for cyclically folding a continuous web in zig-zag fashion comprising:

a frame, web advancing means on said frame adapted to advance said web uniformly at a predetermined speed continuously along a path within said frame, a pair of endless conveying loops mounted on said frame on opposite sides of the web path and each carrying tuckers and grippers alternately spaced thereon and arranged that a tucker of one loop cooperates with a gripper of the other loop to develop a transverse fold in said web and then a gripper of said one loop cooperates with a tucker of said other loop in developing the next transverse fold in said web wherein one cycle is completed between each successive tuckergripper engagement, means on said frame for moving said tuckers and grippers on said loops along divergent paths from a first location where said tuckers and grippers transversely grip said web, said first location being a spaced distance from said advancing means, means on said frame in said path and located between said advancing means and said first location for retarding said web intermittently each cycle between successive tucker-web engagements in said first location, said retarding means including a pair of retard rolls matingly engaging said web to drive it at a surface speed less than said predetermined speed to create a web surplus between said advancing means and said retarding means, a portion of the circumference of one of said rolls having a smaller radius than the remainder thereof to cyclically release said surplus at the time of tucker-web engagement in said first location.

2. The apparatus of claim 1 in which each gripper includes a pair of resilient blocks adhesively secured to its associated loop, each tucked including a T-shaped element secured to its associated loop.

* * * * *